US006672691B1

(12) United States Patent
Hoff

(10) Patent No.: US 6,672,691 B1
(45) Date of Patent: Jan. 6, 2004

(54) CONTROL MECHANISM FOR TAMBOUR-STYLE DOOR CLOSURES

(76) Inventor: David A. Hoff, 94 Shoreview Dr., Cottonwood, MN (US) 56229

( * ) Notice: Subject to any disclaimer, the term of this patent is extended or adjusted under 35 U.S.C. 154(b) by 34 days.

(21) Appl. No.: 10/133,249

(22) Filed: Apr. 26, 2002

Related U.S. Application Data

(60) Provisional application No. 60/287,186, filed on Apr. 27, 2001.

(51) Int. Cl.[7] ..... E06B 9/15; E05F 11/00

(52) U.S. Cl. ..... 312/297; 160/191

(58) Field of Search ..... 312/297; 160/191, 160/201, 198; 16/198, 196

(56) References Cited

U.S. PATENT DOCUMENTS

| | | | | |
|---|---|---|---|---|
| 1,926,452 A | | 9/1933 | Norling | |
| 1,933,925 A | | 11/1933 | Norling | |
| 2,072,582 A | | 3/1937 | Douglass | |
| 2,172,956 A | * | 9/1939 | Derman | 312/260 |
| 2,722,469 A | * | 11/1955 | Kosovsky | 312/310 |
| 2,749,570 A | | 6/1956 | Alder | |
| 3,635,277 A | | 1/1972 | Bahnsen | |
| 3,921,761 A | | 11/1975 | Votroubek et al. | |
| 4,128,120 A | * | 12/1978 | Frey | 160/191 |
| 4,441,768 A | * | 4/1984 | Clarkson | 312/257.1 |
| 4,503,899 A | | 3/1985 | Forquer | |
| 4,712,599 A | * | 12/1987 | Komaki | 160/133 |
| 4,807,684 A | * | 2/1989 | Melton | 160/23.1 |
| 4,882,806 A | | 11/1989 | Davis | |
| 4,981,165 A | | 1/1991 | Miller et al. | |
| 5,419,010 A | | 5/1995 | Mullet | |
| 5,615,723 A | | 4/1997 | Carper | |
| 5,636,678 A | | 6/1997 | Carper et al. | |
| 5,803,563 A | * | 9/1998 | Woodward | 312/297 |
| 5,865,235 A | | 2/1999 | Krupke et al. | |
| 5,964,268 A | | 10/1999 | Carper et al. | |
| 5,975,329 A | * | 11/1999 | Schmitt | 220/350 |
| 6,527,037 B2 | * | 3/2003 | Daus et al. | 160/315 |

FOREIGN PATENT DOCUMENTS

EP 964129 A2 * 12/1999

* cited by examiner

*Primary Examiner*—Anita King
(74) *Attorney, Agent, or Firm*—Haugen Law Firm PLLP

(57) ABSTRACT

A control mechanism for tambour-type door closures helically wound about a winding sleeve for use in combination with cabinetry and including a worm/pinion gear combination releasably locked against free rotation, with controlled rotation of the worm facilitating adjustment of spring tension for controlled ongoing smooth operation of the tambour door closure between open and closed dispositions. The worm/pinion gear combination is coupled to a coiled spring which is helically wound about the tambour door winding spindle with one end of the coil spring being anchored to the rotatable winding spindle means, and with the other being coupled to and fixed for controlled rotational movement with the pinion component of the worm/pinion gear combination. Controlled rotatable motion of the worm is facilitated through the clutching action of the knurled end terminal of the worm gear shaft. The closed position of the tambour door is held against the stored tension of the coil spring by means of a resilient detent member projecting into the lateral guide track for engagement with components of the door panel components.

6 Claims, 6 Drawing Sheets

CONTROL MECHANISM FOR TAMBOUR-STYLE DOOR CLOSURES

CROSS-REFERENCE TO RELATED APPLICATION

The present utility application relates to my copending Provisional Application Serial No. 60/287,186, filed Apr. 27, 2001, entitled "TAMBOUR-STYLE CABINET DOOR".

BACKGROUND OF THE INVENTION

The present invention relates to a control mechanism for tambour-type door closures, and more particularly to such a control mechanism designed for use in combination with cabinetry. Typically, the cabinetry portion of the combination will include a frame with wall panels being secured to one or more sides for creating the enclosure, with at least one of the panels having an access opening formed therein utilizing a tambour-type closure. The tambour closure includes a typical flexible door panel disposed and arranged to be wound about a central receiving spindle mounted spool. The spool comprises a component controlled by the control mechanism and is mounted for rotation within a spindle or sleeve means coupled to the frame, with the sleeve means being arranged to receive or guide each of the opposed ends of the spool. The control mechanism comprises spring tension means which are helically wound about the surface of the spindle, with one end of the spring being secured to the surface of the spindle, and with the other or opposed end of the spring being coupled to the spring tension adjustment means of the control mechanism. The spring tension adjustment means has a housing component coupled to the frame means, and a combination lockable worm-gear/pinion together with the housing is utilized for adjusting the normal tension within the spring. The spring tension adjustment means is initially utilized at the time of installation to create a balance for the tambour door, and is utilized at various intervals thereafter as required to readjust the tension of the spring to achieve continued smooth utilization of the door.

Because of the size constraints imposed upon cabinet manufacturers, it is necessary to minimize the size and volume of hardware utilized with the tambour door closure mechanism. Furthermore, the demands for the manufacture of aesthetically pleasing cabinetry, hardware mechanisms utilized in tambour door closures must not only be highly non-obtrusive, but must provide a readily accessible means for adjusting the spring tension in the closure. In order to satisfy these objectives, purposes and goals, all of which are at cross purposes with convenience and accessibility of the hardware components per se, problems have arisen with regard to providing convenient, effective, and accessible door adjustment means.

Tambour doors are widely accepted and utilized with kitchen cabinetry, including in particular, kitchen appliance garages. While tambour management hardware is presently available, the mechanisms are typically very difficult if not impossible for a typical homeowner to adjust whenever the need for adjustment arises. Typically, adjustment has been either difficult or impractical to accomplish because of the lack of suitable and acceptable hardware mechanism. The need for field adjustment by unskilled individuals is inevitable, and a factory setting cannot be acceptable and satisfactory over long periods of time. Therefore, there is a need for simple and effective field adjustability in cabinetry utilizing tambour doors.

SUMMARY OF THE INVENTION

In accordance with the present invention, a tension adjustment mechanism is provided which satisfies the objectives of ease of operation and accessibility; while at the same time is nonobtrusive. Furthermore, the adjustment is achieved by hand or finger manipulation, without the need for tools. Thus, a close adjustment is possible by unskilled persons utilizing simple tactile feedback during the adjustment operation.

Therefore, it is a primary object of the present invention to provide an improved control mechanism for tambour-type closures with an improved spring tension adjustment means for the central door receiving spool.

It is a further object of the present invention to provide a readily accessible spring tension adjustment mechanism which is hand and/or finger manipulated.

Other and further objects of the present invention will become apparent to those skilled in the art upon a study of the following specification and accompanying drawings.

IN THE DRAWINGS

Figure 7:
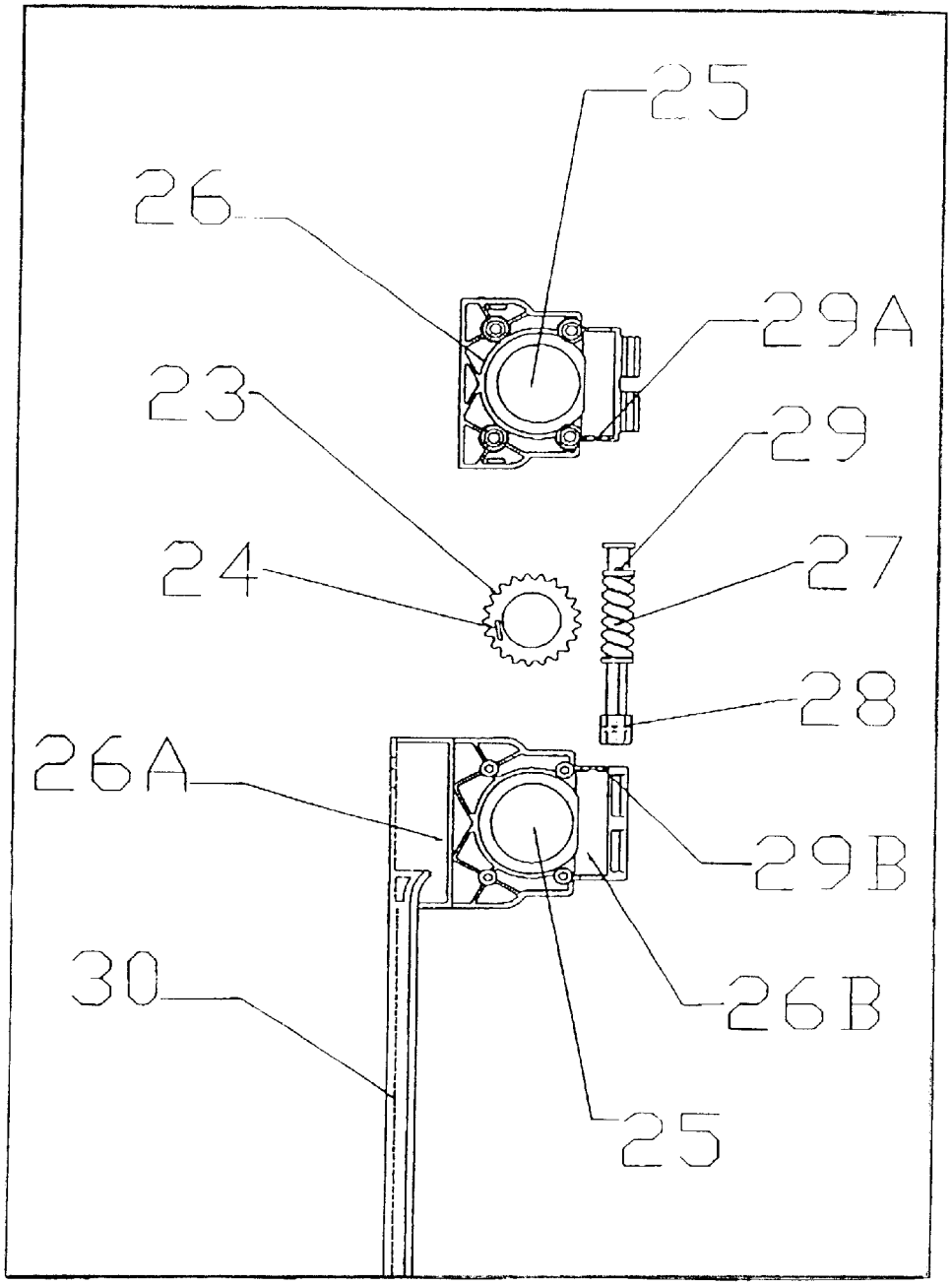
Figure 7A:
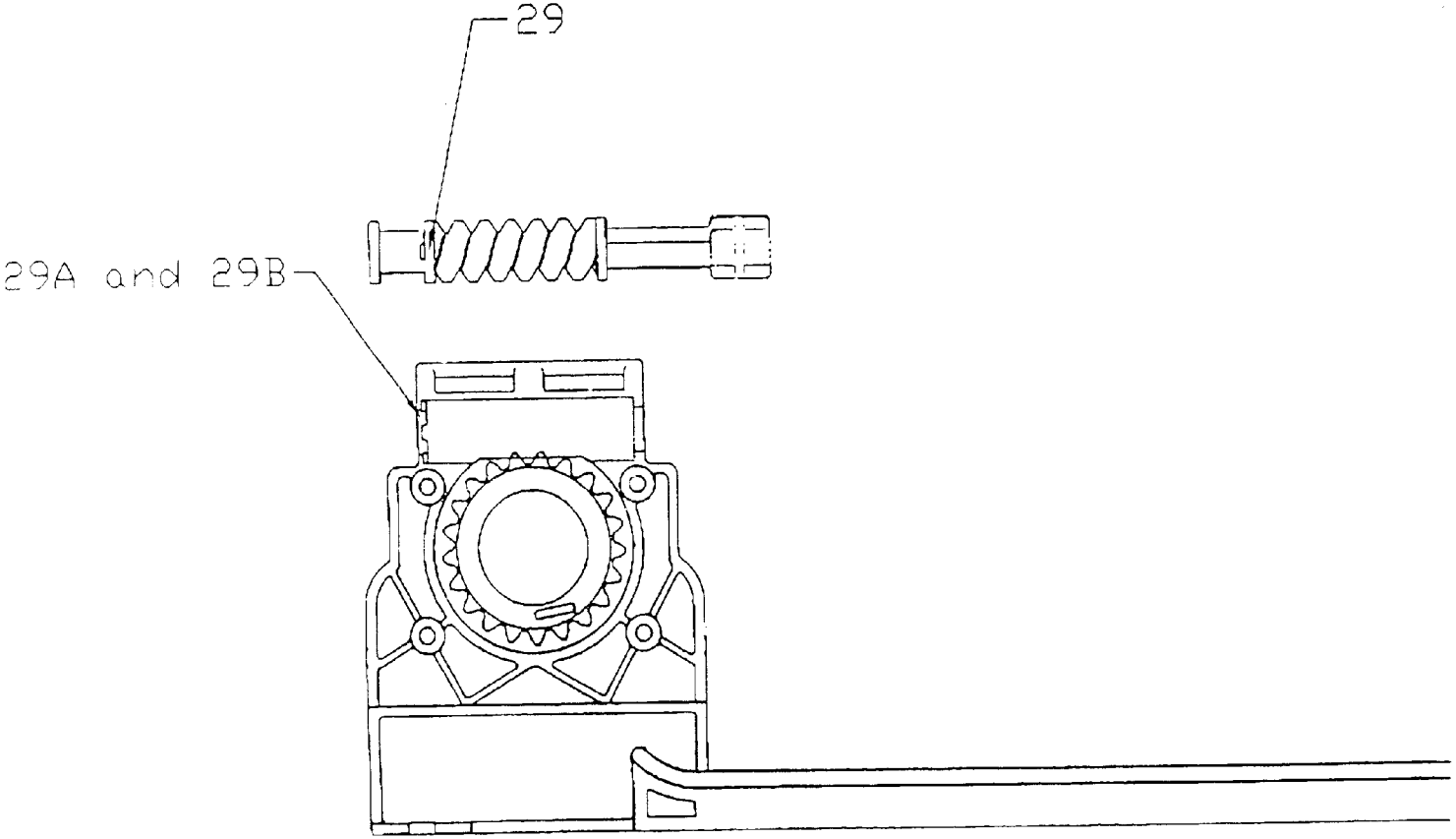
Figure 7B:
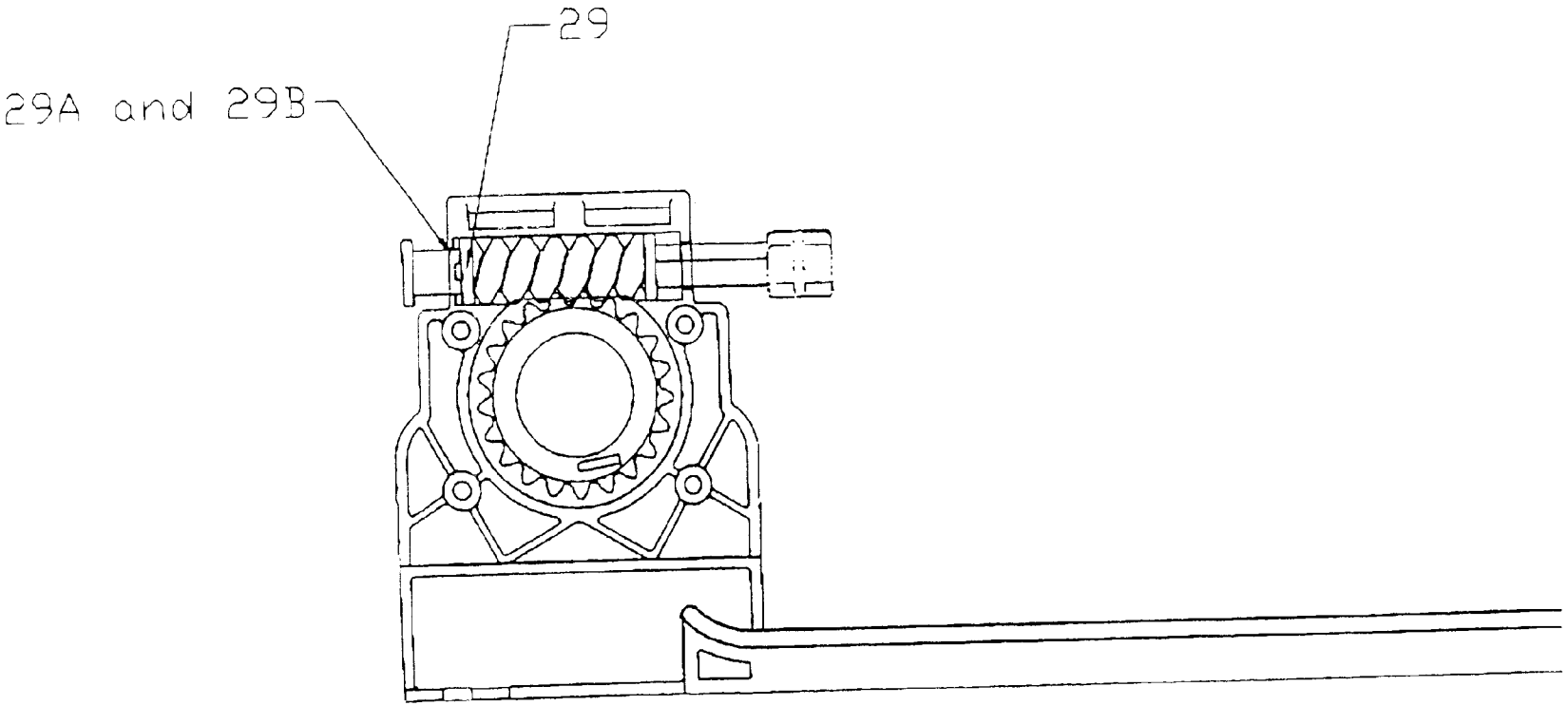

FIG. 7 is a view, in exploded disposition, comprising the housing and control mechanism components utilized in the spring tension adjustment means of the present invention; and FIGS. 7A and 7B are fragmentary elevational views, with FIG. 7A shown in exploded disposition, each serving to illustrate the components and the manner in which the control mechanism functions and locks in place in a typical application.

DESCRIPTION OF THE PREFERRED EMBODIMENT

In accordance with the preferred embodiment of the present invention, the cabinet assembly generally designated 10 includes a frame having components such as stiles 11 and 12, along with a top or upper wall panel 13 secured to the frame. For purposes of illustration, the forward portion of wall panel 13 is cut away for visual access to the tambour door assembly disposed therewithin. In this connection, tambour door generally designated 15 is a closure panel which is helically wound along a convoluted path upon winding spool means 16. At least one winding spool 16 is fast on spindle means 17 which in turn comprises a rod mounted for rotation within stiles 11 and 12. Spool means 16 comprises a pair of axially spaced annular hubs positioned fast on spindle 17 to engage and support the tambour door 15. Spool means 16 has a convoluted configuration with an area such as 16A cut away in order to receive the end segment of tambour door 15 so that when wound helically onto the spool means, a substantially regular or right cylinder is created. One end of the tambour door 15 is accordingly affixed to the spindle 17 through spool means 16—16 to initiate or form the central portion of the helix. With the spindle means 17 being operatively coupled to spring tension adjustment mechanism generally designated 18 (FIGS. 2 and 3), helically wound coil spring 20 provides the required rotary tension through retained or stored counterbalance energy. Helically wound spring mechanisms are known. One end of spring 20 is secured to the surface of spindle 17 as at 21, so as to rotate with spool means 16 or when two or more are utilized spool means 16—16 and spindle 17 as the tambour door 15 is moved between open and closed dispositions. The opposed end of spring 20 is coupled to tension adjustment gear 23. Typically a bore or opening is provided through the structure of gear 23 for receiving a clevis end of helical spring member 20. When it becomes necessary to readjust tension in helically wound coil spring 20, rotation of tension adjustment gear 23 will increase and/or decrease the tension stored within coil spring 20. This adjustment is described hereinbelow.

Figure 3:
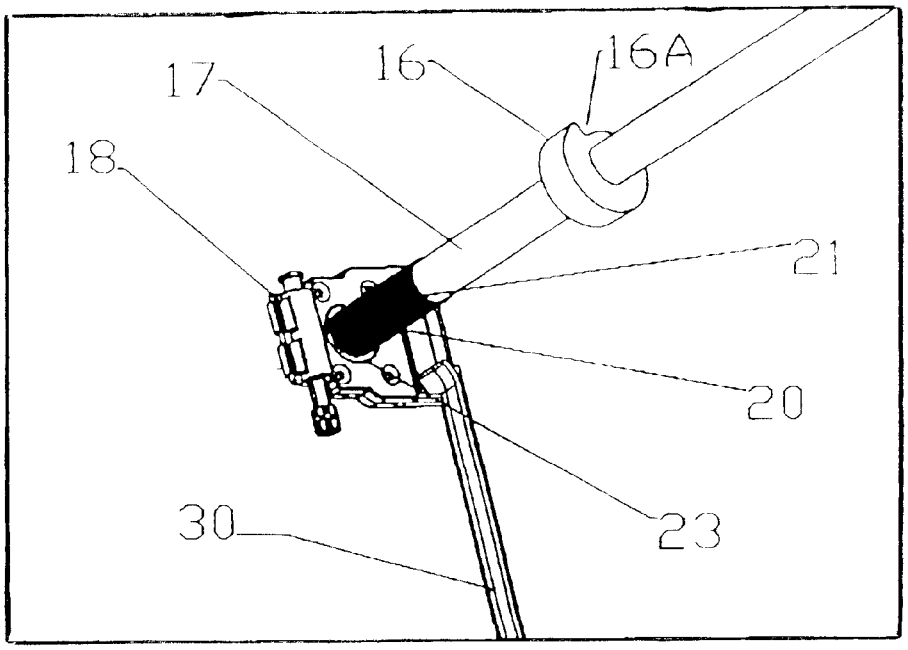
FIG. 3 is a view taken from beneath the cabinet structure with the tambour door having been removed from the spool, and illustrating the spring tension adjustment means.
Figure 5:
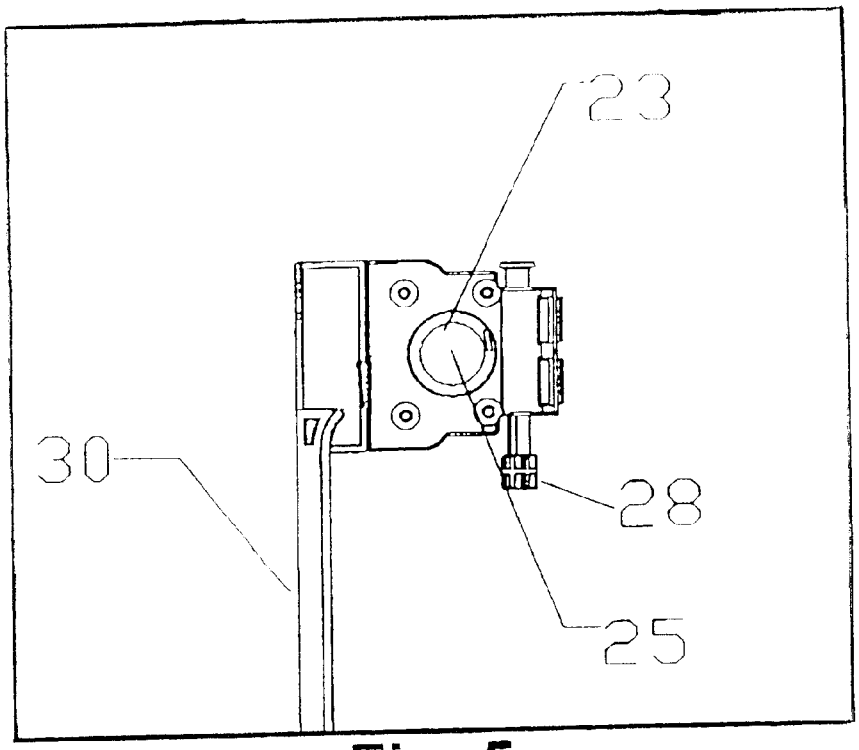
FIG. 5 is an assembled view of the tension adjustment mechanism together with an integrated fragmentary portion of the vertical track.

With attention now being directed to FIGS. 3, 5 and 7, it will be noted that spring tension adjustment mechanism 18 includes a spindle in the form of a spool receiving bore 25, with this bore being jointly formed in a housing comprising closure cap member 26 and its mating base or mirror component 26A. These members are mounted on one end of vertically disposed door guide or track 30 and rigidly and rotatably secure one end of spindle 17 therewithin. Pinion gear 23 comprises an annular body with inner and outer edge surfaces, and with the outer surface comprising a continuous series of teeth. The teeth of pinion gear 23 are in mesh with worm gear 27, with worm gear 27 comprising a series of spiral teeth formed on the outer surface of an elongated shaft 28 having a knurled free end for facilitating manual axial and rotational manipulation of the worm. Worm gear 27 is housed within partially closed sleeve 26B formed within the housing comprising members 26 and 26A. Latching detents are formed along the flange as at 29 of worm gear 27 capture or engage latching dogs or prongs 29A and 29B which are in the disposition shown in FIG. 7A when cap member 26 is inverted upon itself and mated with member 26A. In order to achieve locking engagement between the latching dogs or prongs and the detent. The normal force of helically wound spring 20 is reflected in a rotational force upon pinion 23, with this force, in turn, being reflected in an axial force against worm 27, with this axial force creating the locking engagement of worm 27 within the housing. Upon axial motion of shaft 28 away from the locked position, dogs 29A and 29B are unlocked to permit rotational motion of worm 27 and thus motion is also created in pinion 23. As indicated, in its normal disposition, pinion gear 23 is locked against rotation of spring 20 against worm/pinion mechanism and its clutch function.

In depending relationship to spring tension adjustment mechanism 18, vertically disposed door guide 30 is provided which comprises a tambour door edge receiving track or channel in which motion or travel of the tambour door panel is accommodated. It should be noted that the assembly will include a pair of vertically extending guides 30—30, with guides 30—30 being substantially coextensive with stiles 11 and 12. Also, in FIG. 6, U-shaped or semi-circular mounting points 30A are provided along vertical guide member 30, for example, for use in attachment to the cabinetry frame members, such as member 10 and 11.

In a typical assembly, tambour door 15 is designed to form a closure panel when in extended configuration, and is further arranged to be wound upon spool 16 and supported on the surface of spindle 17 in its opened configuration or disposition. The door 15 is in rolled-up configuration or condition as shown at 35 in FIGS. 2 and 4. In the opposed ends of spindle 17, a pair of opposed guides are provided, each having a spindle receiving sleeve formed thereon with an inner circumference similar to bore 25, thus completing the lateral support mounts for opposed ends of spindle 17. Stops may be provided such as with cups being utilized in lieu of sleeves. Other forms of guides may be conveniently utilized such as, for example, in the form of inwardly projecting coaxial stub shafts adapted to axially engage spindle 17.

Figure 6:
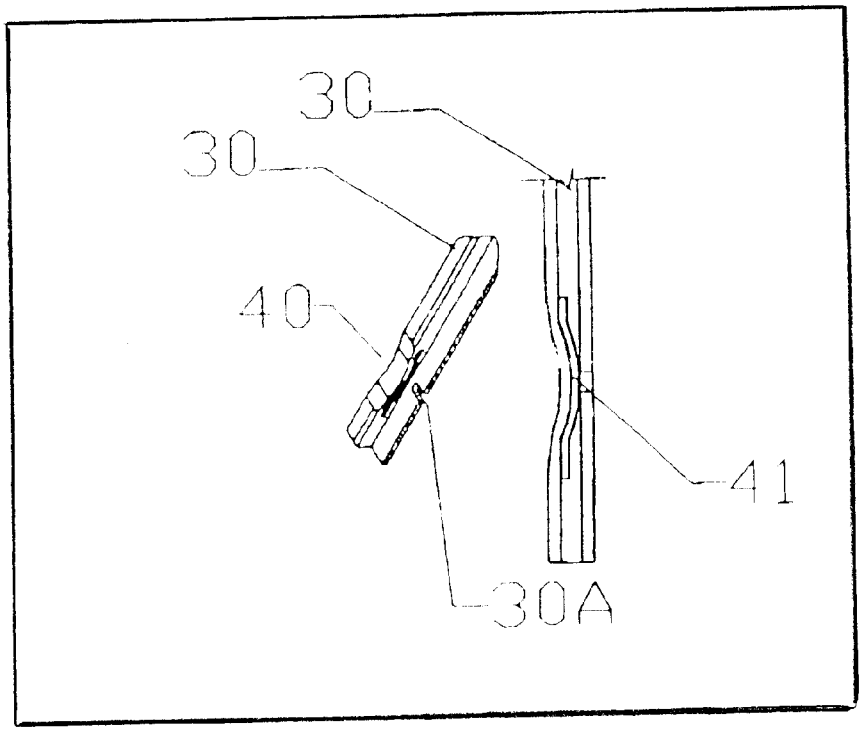
FIG. 6 is a side and isometric view of the rainbow shaped detent and an integrated segment of the vertical channel, illustrating the pinch point employed near the bottom of the vertical guide, to retain the door in its down or closed position.

With attention now being directed to FIG. 6, a pinch point feature is illustrated, shown generally at 40. Pinch point 40 comprises an arcuate, flexible, resilient, rainbow shaped detent, molded to extend into track of guide 30, with detent being indicated as at 41. When tambour door 15 is in its closed disposition, the lower panel such as panel 15A is engaged by detent 41 for providing a frictional force to releasably retain and maintain door 15 is its closed disposition against the static force of spring 20.

Figure 1:
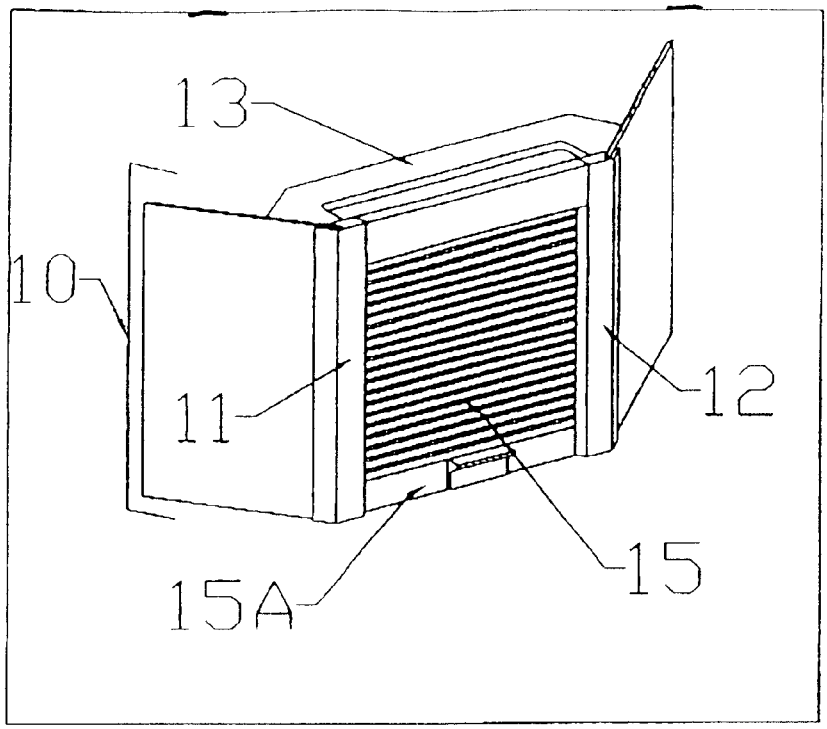
FIG. 1 is a view of the top, front and side panels of a cabinet incorporating the control mechanism for tambour door closures in accordance with the present invention.
Figure 2:
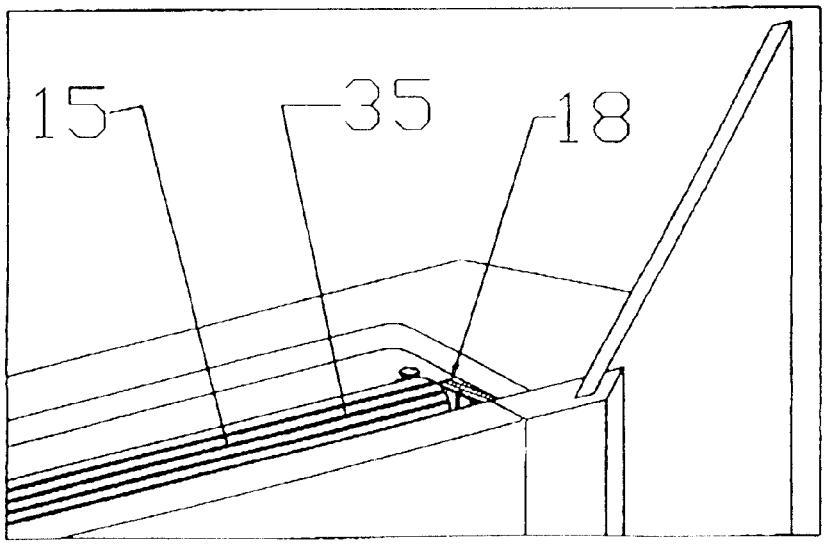
FIG. 2 is a detail view of the top of the cabinet structure, with a portion cut away to illustrate the manner in which the tambour door and control mechanism are received within the cabinet.
Figure 4:
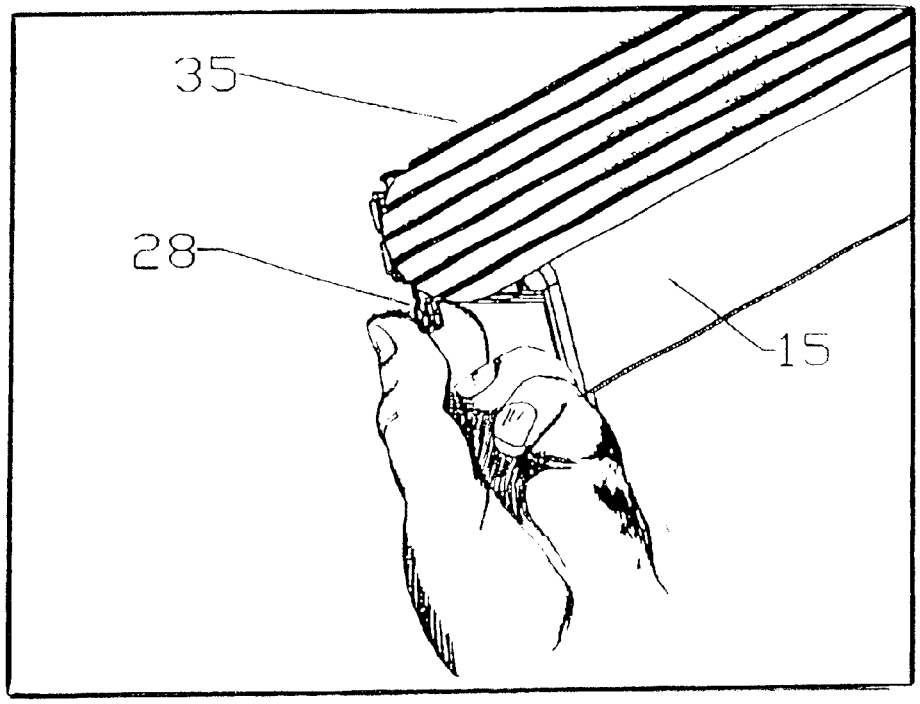
FIG. 4 is a view taken from beneath the cabinet structure, and wherein the tambour door is wound onto and held by the winding spool and illustrating the manner in which the spring tension adjustment means may be hand manipulated.

In actual operation, tambour door 15 is raised from its closed panel-forming disposition (FIG. 1) to its rolled-up or open disposition as shown in FIGS. 2 and 4. These dispositions are typically utilized for the door, with the edges of the door being retained in the track formed in vertical edge guide member 30 (see FIGS. 3, 5 and 7). In its initial installation, spindle 17 of tambour door assembly 15 is placed within bores 25, for example, and its opposed mating bore. Initially, the free clevis end of helical spring 20 is passed through clevis-receiving bore or slot 24 in the body of pinion gear 23. An initial adjustment can be made during assembly to provide the approximate desired tension in the overall system. Thereafter, with the tambour door assembly in place, worm gear 27 is hand manipulated through knurled end 28 in order to rotate pinion gear 23 and the clevis or hook end of coil spring 20 to provide an appropriate measure of tension. Because of its worm-to-pinion pitch settings as well as a releasably interlocking engagement between the worm and its housing, releasable locking engagement is established.

It will be appreciated that various modifications may be made from this description without departing from the spirit of the present invention.

What is claimed is:

1. In a combination, a control mechanism for tambour type closures operatively received within a cabinetry enclosure, with said cabinetry enclosure comprising frame means with wall panels secured thereto for creating said enclosure and with at least one of said wall panels having a tambour receiving access opening formed therein, and with said tambour type closure including a flexible door panel wound about a winding spool means mounted for relative rotation with spindle means coupled to said frame means, and manually operated spring tension adjustment means coupled to said frame means, with said spindle means comprising a rotatable winding spindle; the improvement comprising:

(a) spring means comprising a coil spring helically wound about a periphery of said rotatable winding spindle and having two opposed ends, with one end of said coil spring being anchored to a circumferential surface of said rotatable winding spindle at a point spaced from an end thereof and with the opposed end of said coil spring being coupled to said spring tension adjustment means;

(b) said spring tension adjustment means comprising a worm and pinion gear combination for adjusting tension within said coil spring, with said pinion gear being fastened upon one end of said coil spring and in mesh with said worm, said worm being coupled to an elongated shaft between opposed ends of said shaft, with said elongated shaft further including releasable locking means for preventing free rotation of said worm, and with a knurled peripheral control surface adjacent one end of said elongated shaft for hand manipulation of said elongated shaft.

2. The combination of claim 1 wherein said flexible door panel is wound about said coil spring so as to conceal said coil spring.

3. The combination of claim 1 wherein a free clevis end of said coil spring is passed through a clevis-receiving bore formed in a body of said pinion gear.

4. The combination of claim 1 wherein said releasable locking means includes at least one latching dog mating with said worm, and wherein said latching dog is mounted stationary with said frame means.

5. In combination, a control mechanism for tambour type closures operatively received within a cabinetry enclosure, with said cabinetry enclosure comprising frame means with wall panels secured thereto for creating said enclosure and with at least one of said wall panels having a tambour receiving access opening formed therein, and with said tambour type closure including a flexible door panel wound about a winding spool means mounted for relative rotation with spindle means coupled to said frame means, and manually operated spring tension adjustment means coupled to said frame means, with said spindle means comprising a rotatable winding spindle; the improvement comprising:

(a) spring means comprising a coil spring helically wound about a periphery of said rotatable winding spindle and having two opposed ends, with one end of said coil spring being anchored to a circumferential surface of said rotatable winding spindle at a point spaced from an end thereof and with the opposed end of said coil spring being coupled to said spring tension adjustment means;

(b) said spring tension adjustment means comprising a worm and pinion gear combination for adjusting tension within said coil spring, with said pinion gear being fastened upon one end of said coil spring and in mesh with said worm, said worm being coupled to an elongated shaft between opposed ends of said shaft, with said elongated shaft further including releasable locking means for preventing free rotation of said worm, and with a peripheral control surface adjacent one end of said elongated shaft for hand manipulation of said elongated shaft.

6. In combination, a control mechanism for tambour type closures operatively received within a cabinetry enclosure, with said cabinetry enclosure comprising frame means with wall panels secured thereto for creating said enclosure and with at least one of said wall panels having a tambour receiving access opening formed therein, and with said tambour type closure including a flexible door panel wound about a winding spool means mounted for relative rotation with spindle means coupled to said frame means, with said spindle means comprising a rotatable winding spindle, with the control mechanism comprising:

a) manually operated spring tension adjustment means coupled to said frame means;

b) a coil spring engaged between the rotatable winding spindle and the manually operated spring tension adjustment means; and c) said manually operated spring tension adjustment means comprising a worm and pinion gear combination for adjusting tension within said coil spring, with said pinion gear being engaged to said coil spring and in mesh with said worm, said worm being coupled to an elongated shaft, with said elongated shaft further including releasable locking means for preventing free rotation of said worm, and with a peripheral control surface adjacent one end of said elongated shaft for hand manipulation of said elongated shaft.

* * * * *